US005804531A

United States Patent [19]

Evans et al.

[11] Patent Number: 5,804,531

[45] Date of Patent: Sep. 8, 1998

[54] THERMAL DYE TRANSFER SYSTEM WITH POLYESTER IONOMER RECEIVER

[75] Inventors: Steven Evans; Teh-Ming Kung; Kristine B. Lawrence; Richard C. VanHanehem, all of Rochester, N.Y.

[73] Assignee: Eastman Kodak Company, Rochester, N.Y.

[21] Appl. No.: 995,728

[22] Filed: Dec. 22, 1997

[51] Int. Cl.[6] ..... B41M 5/035; B41M 5/38

[52] U.S. Cl. ..... 503/227; 428/195; 428/480; 428/913; 428/914

[58] Field of Search ..... 8/471; 428/195, 428/480, 913, 914; 503/227

[56] References Cited

U.S. PATENT DOCUMENTS 5,534,478 7/1996 Bowman et al. ..... 503/227

*Primary Examiner*—Bruce H. Hess
*Attorney, Agent, or Firm*—Harold E. Cole

[57] ABSTRACT

A thermal dye transfer assemblage comprising:

(a) a dye-donor element comprising a support having thereon a dye layer comprising a dye dispersed in a polymeric binder, the dye being:

I) an electrically neutral, deprotonated, delocalized cationic dye precursor;

II) a pendant basic dye of the formula D-(L-E)$_m$ wherein D represents the residue of a dye, L represents a covalent linking group, E represents a moiety with basic properties and m is an integer of 1–3; or III) a cationic dye precursor having the following structure:

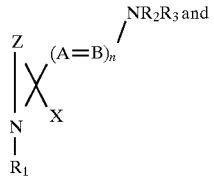

(b) a dye-receiving element comprising a support having thereon a polymeric dye image-receiving layer, the dye-receiving element being in a superposed relationship with the dye-donor element so that the dye layer is in contact with the dye image-receiving layer, the dye image-receiving layer comprising a polyester ionomer comprising a polyester backbone containing units of a salt of a sulfonic acid or sulfonimide and a basic nitrogen-containing compound which has a pKa of its conjugate acid in the range from about 6 to about 10.

8 Claims, No Drawings

THERMAL DYE TRANSFER SYSTEM WITH POLYESTER IONOMER RECEIVER

FIELD OF THE INVENTION

This invention relates to a dye-receiving element for thermal dye transfer imaging comprising an acidic substance capable of protonating a thermally transferred basic dye.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Commonly-used dyes are nonionic in character because of the easy thermal transfer achievable with this type of compound. The dye-receiver layer usually comprises an organic polymer with polar groups to act as a mordant for the dyes transferred to it. A disadvantage of such a system is that since the dyes are designed to be mobile within the receiver polymer matrix, the prints generated can suffer from dye migration over time.

There is a need to provide thermal dye transfer imaging systems that yield images which are resistant to degradation by contact with other surfaces, chemicals, fingerprints, etc. Such image degradation is often the result of continued migration of the transferred dyes after the printing step.

One approach to reducing the continued migration of the transferred dyes is to utilize basic dyes which are capable of reacting with polymeric acidic substances in the receiver element to form strong electrostatic dye-polymer bonds.

DESCRIPTION OF RELATED ART

U.S. Pat. No. 5,534,478 describes a dye-receiving element for thermal dye transfer using basic dyes comprising a polyester ionomer comprising a polyester backbone containing units of a sulfonic acid or a sulfonimide. However, there is a problem with certain acidic polymers comprising polyester ionomers containing units of a sulfonic acid or sulfonimide. In the presence of moisture, either in a coating composition or in a coated film, these polyester ionomers undergo significant hydrolytic decomposition, leading to unstable coating compositions and coatings with poor physical integrity due to the significant drop in polymer molecular weight that results from hydrolytic decomposition.

It is the object of this invention to provide an assemblage comprising a dye-receiver containing an acidic substance comprising a polyester ionomer which is more stable yet still capable of effectively protonating a wide variety of basic dyes which are transferred to it.

SUMMARY OF THE INVENTION

This and other objects are achieved in accordance with this invention which relates to a thermal dye transfer assemblage comprising:

(a) a dye-donor element comprising a support having thereon a dye layer comprising a dye dispersed in a polymeric binder, the dye being:

I) an electrically neutral, deprotonated, delocalized cationic dye precursor;

II) a pendant basic dye of the formula $D\text{-}(L\text{-}E)_m$ wherein D represents the residue of a dye, L represents a linking group, E represents a moiety with basic properties and m is an integer of 1–3; or III) a cationic dye precursor having the following structure:

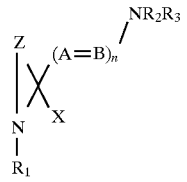

wherein:

$R_1$, $R_2$ and $R_3$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

A and B each independently represents N or CR and may be part of an aromatic or heteroaromatic ring system;

X represents —OR, $—N(R)_2$, —NRCOR, $—NRSO_2R$, —SR, $—SO_2R$, —S(O)R, $—O_2CR$, $—NRCON(R)_2$, $—OCON(R)_2$, $—SO_2N(R)_2$ or —NRCOOR; wherein each R independently represents H or $R_1$;

Z represents the atoms necessary to complete a 5- or 6-membered heterocyclic ring which may optionally be fused with other carbo- or heterocyclic rings;

n represents an integer of from 1–5;

X and $R_1$ may be combined to form a 5–7 membered ring; and;

$R_2$ and $R_3$ may be combined together or independently combined with A or B to form a 5–7 membered ring; and (b) a dye-receiving element comprising a support having thereon a polymeric dye image-receiving layer, the dye-receiving element being in a superposed relationship with the dye-donor element so that the dye layer is in contact with the dye image-receiving layer, the dye image-receiving layer comprising a polyester ionomer comprising a polyester backbone containing units of a salt of a sulfonic acid or sulfonimide and a basic nitrogen-containing compound which has a pKa of its conjugate acid in the range from about 6 to about 10.

DESCRIPTION OF THE PREFERRED EMBODIMENTS

It has been found that dye-receiving elements comprising polyester ionomers containing units of a salt of a sulfonic acid or sulfonimide and basic nitrogen-containing compounds which have a pKa of their conjugate acids in the range of about 6 to about 10 are surprisingly effective at protonating and binding thermally transferred basic dyes. In addition, these polymers are more stable towards hydrolytic decomposition, and coating compositions containing them are more stable towards coagulation than are the polymers and coating compositions of the prior art.

In a preferred embodiment of the invention, the polyester ionomers employed have the following general formula:

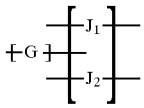

wherein G is the residue of one or more diol components which together comprise 100 mole % of recurring units and is represented by the following structure:

$$—O—(CHR_4CHR_5B_1)_p—R_6—(OCHR_4CHR_5)_q—O—$$

wherein:

p and q each independently represents an integer from 0–4;

$R_6$ represents an alkylene group of 1 to about 16 carbon atoms; a cycloalkylene group of 5 to about 20 carbon atoms; a cyclobisalkylene group of about 8 to about 20 carbon atoms; a bi- or tri-cycloalkylene group of about 7 to about 16 carbon atoms; a bi- or tri-cyclobisalkylene group of about 9 to about 18 carbon atoms, an arenebisalkylene group of from 8 to about 20 carbon atoms, or an arylene group of from 6 to about 12 carbon atoms; and $R_4$ and $R_5$ each independently represents H, a substituted or unsubstituted alkyl group of about 1 to about 6 carbon atoms, or a substituted or unsubstituted aryl group of about 6 to about 12 carbon atoms;

$B_1$ represents O or S;

$J_1$ represents the residue of a diacid component which comprises 8 to 30 mole % of recurring units and is represented by one or more of the following structures:

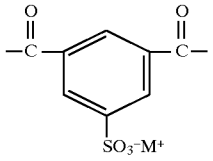

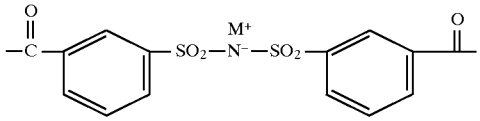

-continued

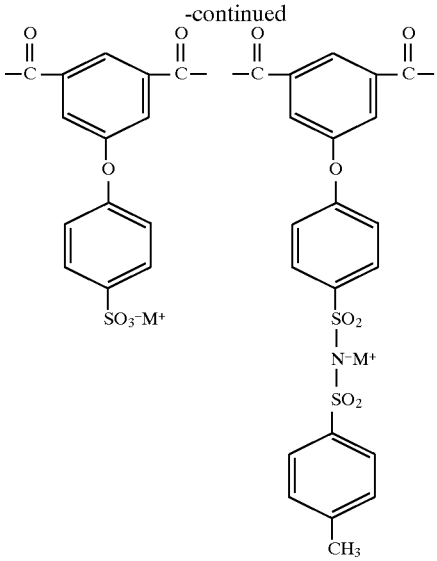

wherein $M^+$ represents the protonated or conjugate acid form of a basic, nitrogen-containing moiety having a pKa measured in water of from about 6 to about 10; and $J_2$ represents the residue of a diacid component which comprises 70 to 92 mole % of recurring units and is represented by one or more of the following structures:

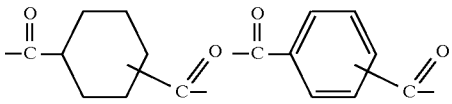

or

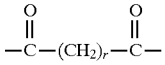

where r represents an integer from 2 to 10.

Some typical diols corresponding to G above include ethylene glycol, diethylene glycol, triethylene glycol, thiodiethanol, cyclohexanedimethanol, bisphenol A, trans-1,4-cyclohexanediol, dodecanediol, cis-exo-2,3-norbornanediol, 5-norbomene-2,2-dimethanol, etc.

The aqueous pKa values for many nitrogen-containing compounds are tabulated in chemistry reference texts, for instance, *Lange's Handbook of Chemistry,* 11$^{th}$ ed., John A. Dean, ed., McGraw-Hill, 1972 (pp. 5-13 to 5-39) and *The CRC Handbook of Chemistry and Physics,* 69$^{th}$ ed., R. C. Weast, editor-in-chief, CRC Press, 1988 (pp. D-159 to D-161).). Also, a useful tabulation can be found in W. Huber, *Titrations in Non-Aqueous Solvents,* Academic Press, 1967 (pp. 215–229).

Examples of conjugate acids of basic nitrogen-containing compounds which have a pKa in the range from about 6 to about 10 which may be used in the invention include the following ($M^+$ in the above formula): ammonium (9.2), N,N-diethylanilinium (6.6), imidazolium (7.0), trans-cyclohexane-diammonium (6.3 and 9.7), N,N-diethyl-o-toluidinium (7.2), diethanolammonium (8.9), N,N-dimethylbenzylammonium (9.0), hydroxylammonium (6.0), 3-hydroxypyridinium (8.7), 4-tert-butylpyridinium (6.2), triethanolammonium (7.8), methoxyethylammonium (9.4), 4-methylimidazolium (7.4), N-methylmorpholinium (7.1), morpholinium (8.7), phenethylammonium (9.8) and trimethylammonium (9.8).

Examples of polyester ionomers employed in the invention include the following:

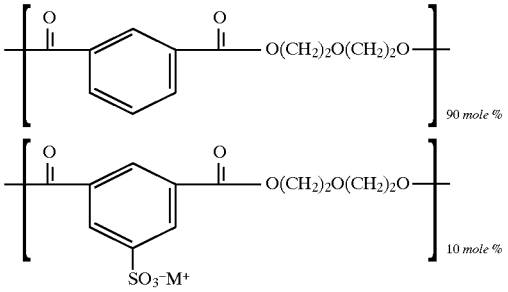

| Polyester Ionomer No. | $M^+$ |
|---|---|
| I-1 | $NH_4^+$ |
| I-2 | $NH(C_2H_4OH)_3^+$ |
| I-3 | 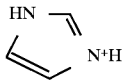 |
| I-4 | 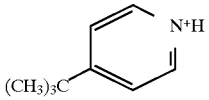 |

The polyester ionomers employed in the invention may be used alone or in combination with other polymers having no or slight acidity. These other polymers include condensation polymers such as polyesters, polyurethanes, polycarbonates, etc.; addition polymers such as polystyrenes, vinyl polymers, acrylic polymers, etc.; or block copolymers containing large segments of more than one type of of polymer covalently linked together. In a preferred embodiment of the invention, an acrylic polymer, a styrene polymer or a vinyl polymer having a Tg of less than 19° C. is used. These polymers may be employed at a concentration ranging from about 0.5 g/m$^2$ to about 10 g/m$^2$ and may be coated from organic solvents or water, if desired.

Examples of such other polymers include the following:

Polymer A: poly(butyl acrylate-co-allyl methacrylate) 98:2 wt core/poly(glycidyl methacrylate) 10 wt shell, (Tg=−40° C.)

Polymer B: poly(butyl acrylate-co-allyl methacrylate) 98:2 wt core/poly(ethyl methacrylate) 30 wt shell, (Tg=−41° C.)

Polymer C: poly(butyl acrylate-co-allyl methacrylate) 98:2 wt core/poly(2-hydroxypropyl methacrylate) 10 wt shell, (Tg=−40° C.)

Polymer D: poly(butyl acrylate-co-ethylene glycol dimethacrylate) 98:2 wt core/poly(glycidyl methacrylate 10 wt shell, Tg=−42° C.)

Polymer E: poly(butyl acrylate-co-allyl methacrylate-co-glycidyl methacrylate) 89:2:9 wt, (Tg=−34° C.)

Polymer F: poly(butyl acrylate-co-ethylene glycol dimethacrylate-co-glycidyl methacrylate) 89:2:9 wt (Tg=−28° C.)

Polymer G: poly(butyl methacrylate-co-butyl acrylate-co-allyl methacrylate) 49:49:2 wt core/poly(glycidyl methacrylate) 10 wt shell, (Tg=−18° C.)

Polymer H: poly(methyl methacrylate-co-butyl acrylate-co-2-hydroxyethyl methacrylate-co-2-sulfoethyl methacrylate sodium salt) 30:50:10:10 wt, (Tg=−3° C.)

Polymer I: poly(methyl methacrylate-co-butyl acrylate-co-2-hydroxyethyl methacrylate-co-styrenesulfonic acid sodium salt) 40:40:10:10 wt, (Tg=0° C.)

Polymer J: poly(methyl methacrylate-co-butyl acrylate-co-2-sulfoethyl methacrylate sodium salt-co-ethylene glycol dimethacrylate) 44:44:10:2 wt, (Tg=14° C.)

Polymer K: poly(butyl acrylate-co-Zonyl TM®-co-2-acrylamido-2-methyl-propanesulfonic acid sodium salt) 50:45:5 wt (Tg=−39° C.) (Zonyl TM® is a monomer from the DuPont Company)

Polymer L: XU31066.50 (experimental polymer based on a styrene butadiene copolymer from Dow Chemical Company) (Tg=−31° C.)

Polymer M: AC540® nonionic emulsion (Allied Signal Co.) (Tg=−55° C.)

The polyester ionomer polymer in the dye image-receiving layer of the assemblage of the invention may be present in any amount which is effective for its intended purpose. In general, good results have been obtained at a concentration of from about 0.5 to about 10 g/m$^2$. The polymers may be coated from organic solvents or water, if desired.

As noted above, there are three different types of dyes which may be employed in the dye-donor element of the assemblage of the invention. The first type of dye is an electrically neutral, deprotonated, delocalized cationic dye precursor. In a preferred embodiment of the invention, these dyes have the following formula:

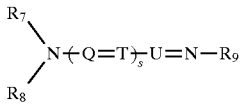

wherein:

Q, T and U form a conjugated link between nitrogen atoms selected from CH, C-alkyl, N, or a combination thereof, the conjugated link optionally forming part of an aromatic or heterocyclic ring;

$R_7$ represents H or a substituted or unsubstituted alkyl group from about 1 to about 10 carbon atoms;

$R_8$ and $R_9$ each individually represents H or a substituted or unsubstituted phenyl or a substituted or unsubstituted alkyl group from about 1 to about 10 carbon atoms; and s is 0 or an integer from 1 to 11.

Further examples of these dyes are found in U.S. Pat. Nos. 4,880,769; 5,534,478; and 5,559,076, the disclosures of which are hereby incorporated by reference. Specific examples of these dyes include the following which also have listed the absorption maxima of the deprotonated and protonated species, with the values for the latter shown in parentheses:

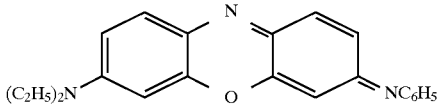

Dye 1
λ max 556 nm (641 nm)
magenta (cyan)

-continued

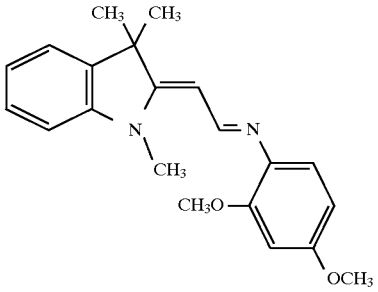

Dye 2
λ max 379 nm (405 nm)
yellow (yellow)

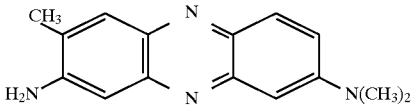

Dye 3
λ max 459 nm (536 nm)
yellow (magenta)

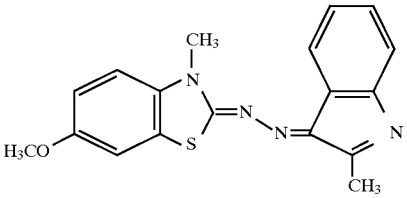

Dye 4
λ max 459 nm (522 nm)
yellow (magenta)

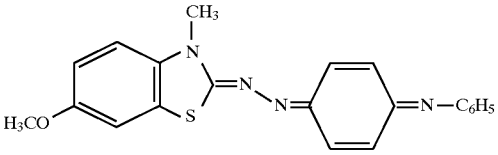

Dye 5
λ max 503 nm (621 nm)
red (blue)

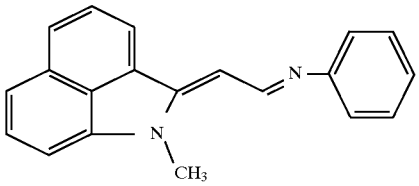

Dye 6
λ max 479 nm (513 nm)
yellow (magenta)

-continued

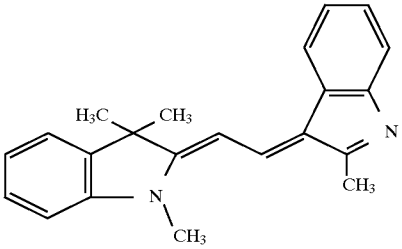

Dye 7
λ max 485 nm (495)
orange (orange)

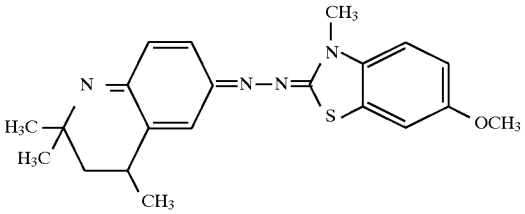

Dye 8
λ max 472 nm (601)
orange (blue)

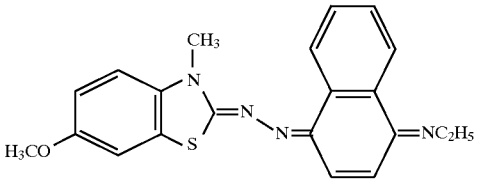

Dye 9
λ max 469 nm (618)
yellow (blue)

The second type of dye which may be employed in the dye-donor element of the assemblage of the invention has a pendant basic group as described above. Examples of these dyes are found in Japanese Patent Application J05/238174, the disclosure of which is hereby incorporated by reference. Specific examples of these dyes include the following:

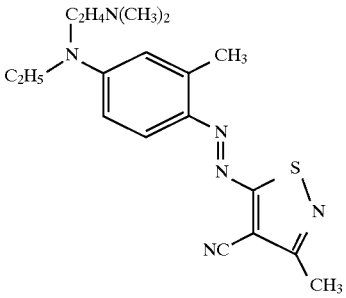

Dye 10

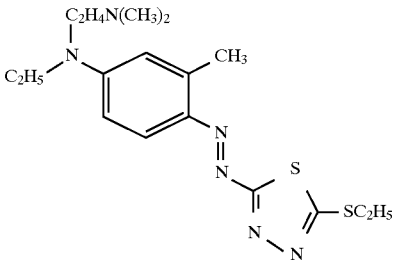

Dye 11

The third type of dye which may be employed in the dye-donor element of the assemblage of the invention is a cationic dye precursor as described above. In a preferred embodiment, this dye has the following formula:

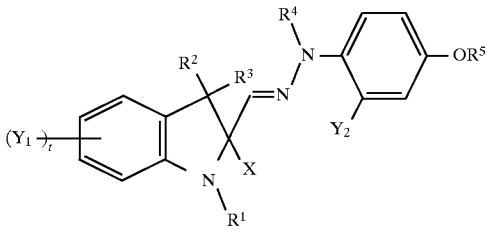

wherein:

$R^1$, $R_2$, $R^3$, $R^4$ and $R^5$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

X represents —OR, —$N(R)_2$, —NRCOR, —$NRSO_2R$, —SR, —$SO_2R$, —S(O)R, —$O_2CR$, —$NRCON(R)_2$, —$OCON(R)_2$, —$SO_2N(R)_2$ or —NRCOOR; wherein each R independently represents H or $R^1$;

$Y_1$ and $Y_2$ each independently represents R, halogen, CN, alkoxy, aryloxy, allylthio, arylthio, alkoxycarbonyl, aryloxycarbonyl, acylamino, sulfonylamino, nitro, alkylsulfonyl, arylsulfonyl or thiocyano;

t represents an integer of from 1–4;

X and $R^1$ may be combined together with the atoms to which they are attached to form a 5–7 membered ring;

any two of $Y_1$ may be combined to form additional fused rings; and $R^2$ and $R^3$ may be combined together to form a 5–7 membered ring.

Specific examples of these dyes include the following:

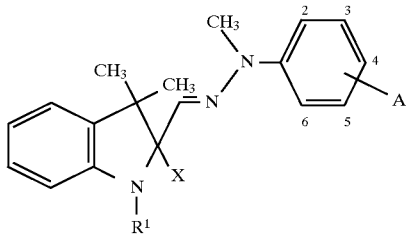

| Dye Precursor | $R^1$ | X | A | Molecular Weight | λmax (nm) (ε-max)[1] |
|---|---|---|---|---|---|
| 12 | $CH_3$ | OH | 4-$OCH_3$ | 339 | 449 (36,300) |
| 13 | —$CH_2CH_2O$— | | 4-$OC_6H_5$ | 413 | 444 (39,100) |
| 14 | —$CH_2CH_2CONH$— | | 2,4-$(OCH_3)_2$ | 408 | 426 (31,500) |
| 15 | —$CH_2CH_2CONH$— | | 4-$OCH_3$ | 378 | 455 (38,100) |
| 16 | —$CH_2CH_2O$— | | 4-$OCH_3$ | 351 | 455 (36,000) |
| 19 | —$CH_2CH(CH_2OH)O$— and —$CH_2CH(OH)CH_2O$— (mixture) | | 4-$OC_6H_5$ | 443 | 446 (38,900) |
| 17 | —$CH_2CH(CH_2OH)O$— and —$CH_2CH(OH)CH_2O$— (mixture) | | 2,4-$(OCH_3)_2$ | 411 | 422 (29,300) |
| 18 | —$CH_2CH_2O$— | | 4-$OCH_2CONHCH_3$ | 408 | 448 (38,100) |

[1]In ethanol containing HCl, ε = molar absorbtivity

Further examples of these dyes are found in copending application Ser. No. 08/996,388, filed of even date herewith by Evans, Pyszczek and Weber, entitled Dye-Donor Element for Thermal Dye Transfer.

The support for the dye-receiving element employed in the invention may be transparent or reflective, and may comprise a polymeric, a synthetic paper, or a cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 $\mu$m to 1000 $\mu$m. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150; 4,965,238; 4,965,239; and 4,965,241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Resistance to sticking during thermal printing may be enhanced by the addition of release agents to the dye-receiving layer or to an overcoat layer, such as silicone-based compounds, as is conventional in the art.

Dye-donor elements that are used with the dye-receiving element of the invention conventionally comprise a support having thereon a dye layer containing the dyes as described above dispersed in a polymeric binder such as a cellulose derivative, e.g., cellulose acetate hydrogen phthalate, cellulose acetate, cellulose acetate propionate, cellulose acetate butyrate, cellulose triacetate, or any of the materials described in U.S. Pat. No. 4,700,207; or a poly(vinyl acetal) such as poly(vinyl alcohol-co-butyral). The binder may be used at a coverage of from about 0.1 to about 5 g/m$^2$.

As noted above, dye-donor elements are used to form a dye transfer image. Such a process comprises imagewise heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dyes as described above, and the dye transfer steps are sequentially performed for each color to obtain a three-color dye transfer image. Of course, when the process is only performed for a single color, then a monochrome dye transfer image is obtained.

Thermal print heads which can be used to transfer dye from dye-donor elements to the receiving elements of the invention are available commercially. There can be employed, for example, a Fujitsu Thermal Head (FTP-040 MCS001), a TDK Thermal Head F415 HH7–1089 or a Rohm Thermal Head KE 2008-F3. Alternatively, other known sources of energy for thermal dye transfer may be used, such as lasers.

When a three-color image is to be obtained, the assemblage described above is formed on three occasions during the time when heat is applied by the thermal printing head. After the first dye is transferred, the elements are peeled apart. A second dye-donor element (or another area of the donor element with a different dye) is then brought in register with the dye-receiving element and the process repeated. The third color is obtained in the same manner. After thermal dye transfer, the dye image-receiving layer contains a thermally-transferred dye image.

The following examples are provided to further illustrate the invention.

EXAMPLES

Example 1

Preparation of Polyester Ionomers Containing Amine Salts of Sulfonic Acids

Approximately 15 mL of an ion-exchange resin (Dowex 50W-X8®, sodium form) was loaded into a burette and rinsed with 50 mL of distilled water. A solution of the appropriate amine hydrochloride (0.15 mole in 50 mL water) was then passed through the ion-exchange column at a rate of 1–2 drops/sec. followed by 100 mL of water. Then 35 g of a 30% aqueous dispersion of AQ29D® polyester ionomer (sodium salt) (Eastman Chemical Co.) was passed through the column at a rate of 1 drop/sec. The first, hazy 1 mL of eluent was discarded. The remaining eluent was collected and the column rinsed with water until the viscosity of the eluent dropped to that of water. The dispersion of ion-exchanged polyester ionomer was analyzed for % solids and titrated for acid content to confirm the efficiency of the ion exchange. The results are shown in Table 1 along with the data for control polymers C-1 and C-2.

Examples of control polyester ionomers include the following:

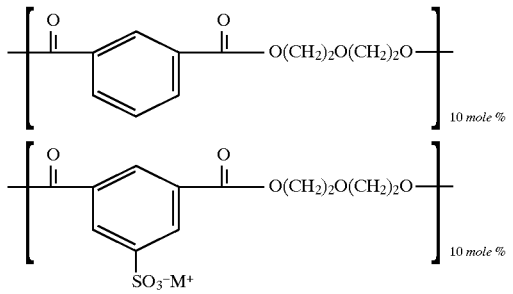

| Polyester Ionomer No. | $M^+$ |
|---|---|
| C-1 | $Na^+$ |
| AQ29D ® (Eastman Chemical) | |
| C-2-Polymer 1 of U.S. Pat. 5,534,478 | $H^+$ |
| C-3 | 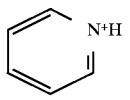 |

TABLE 1

| Polyester ionomer | Dispersion - % Solids | Acid content (meq/g on a dry weight basis) |
|---|---|---|
| I-1 | 29.7 | 0.52 |
| I-2 | 26.8 | 0.37 |
| I-3 | 30.0 | 0.47 |
| I-4 | 29.9 | 0.38 |
| C-1 | 30.0 | not acidic |
| C-2 | 30.0 | 0.42 |
| C-3 | 29.7 | 0.48 |

Hydrolytic Stability of Polyester Ionomers

Each of the above polyester ionomer dispersions was then coated onto a 170 μm thick poly(ethylene terephthalate) support at 21° C. and dried at 54° C. The wet laydown was adjusted based on the measured % solids to give a dry film thickness of 5.4 g/m$^2$.

The coatings were equilibrated at ambient conditions for approximately 16 hours. A 10 cm×25.4 cm piece of each coating was then placed into a controlled environment chamber maintained at 50° C. and 50% relative humidity for a period of one week. A similar piece of each coating was maintained in a 0° C. chamber as a control. Following the incubation, the polyester ionomer layer was removed from the support by dissolving in 90:10 tetrahydrofuran-methanol, the solvents were removed by evaporation, and the PEO-equivalent molecular weight of the polyester ionomer residue was measured by size exclusion chromatography on a Waters Associates HPLC instrument fitted with two Jordi 10 μm mixed bed columns eluted with dimethylformamide containing 0.01M lithium nitrate. The percent loss of molecular weight of each incubated sample relative to that of its unincubated control coating was calculated and listed in Table 2.

TABLE 2

| Polyester Ionomer No. | pKa of $M^+$ | Percentage Loss of Molecular Weight After Incubation |
|---|---|---|
| I-1 | 9.2 | 8 |
| I-2 | 7.8 | 1 |
| I-3 | 7.0 | 1 |
| I-4 | 6.2 | 39 |
| C-1 | not applicable | 0 |
| C-2 | −7.0 | 90 |
| C-3 | 5.2 | 92 |

As can be seen by the data in Table 2, the polyester ionomers of the invention containing units of a salt of a sulfonic acid and basic nitrogen-containing compounds which have a pKa of their conjugate acids in the range of about 6 to about 10 are much more stable to hydrolytic decomposition (much less loss of molecular weight) than are the sulfonic acid-containing polymers of the prior art or those containing units of a salt of a sulfonic acid of and a nitrogen-containing compound having a pKa of their conjugate acids of less than about 6. Control polyester ionomer C-1 is hydrolytically stable but has no acidic character and is incapable of protonating or binding thermally transferred basic dyes as win be shown below.

Example 2

Preparation and Evaluation of Thermal Dye Transfer Images

Preparation of Dye-Receiving Elements

The receiving element described below was prepared by first extrusion laminating a paper core with a 38 μm thick microvoided composite film (OPPalyte 350TW®, Mobil Chemical Co.) as disclosed in U.S. Pat. No. 5,244,861.

The composite film side of the above laminate was coated with the following layers in the order recited:

1) a subbing layer of Polymin P®, (aqueous polyethyleneimine, BASF Corp.) (0.04 g/m$^2$) coated from water [or, in the case of Control Receiving Element C-2, a subbing layer of Prosil® 221 (aminopropyl triethoxysilane) and 2210 (an aminofunctional epoxysilane) (0.05 g/m$^2$ each), (both available from PCR, Inc.) coated from 3A alcohol]; and
2) a receiving layer composed of Polymer A (above, see Table 3 for amounts), polyester ionomers of the invention or control polyester ionomers (see Table 3 for amounts) and a fluorocarbon surfactant (Fluorad FC-170C®, 3M Corporation, 0.022 g/m$^2$) coated from water. The levels of the polyester ionomers were adjusted based on their measured acid content so that the acid level in each receiver element would be similar. The levels of non-acidic polymer were also adjusted to yield a total coated thickness of 6.73 g/m$^2$. Details of the receiving element compositions are listed in Table 3.

TABLE 3

| Dye-Receiving Element | Polyester Ionomer | Polyester Ionomer Laydown (g/m$^2$) | Polymer A Laydown (g/m$^2$) |
|---|---|---|---|
| I-1 | I-1 | 2.18 | 4.54 |
| I-2 | I-2 | 3.08 | 3.65 |
| I-3 | I-3 | 2.40 | 4.33 |
| I-4 | I-4 | 3.00 | 3.72 |
| C-1 | C-1 | 2.69 | 4.04 |
| C-2 | C-2 | 2.69 | 4.04 |
| C-3 | C-3 | 2.36 | 4.37 |

Preparation of Dye-Donor Elements

Individual dye-donor elements were prepared by coating the compositions described below in the order listed on a 6 μm poly(ethylene terephthalate) support:

Dye-donor Element 1:

1) a subbing layer of Tyzor TBT®, a titanium tetrabutoxide, (DuPont Corp.) (0.16 g/m$^2$), coated from 1-butanol; and
2) a dye layer containing Dye 1 (0.16 g/m$^2$), a mixture of cellulose acetate propionates 482-.5 and 482-20 (0.086 g/m$^2$ each), (Eastman Chemical Company), poly(butyl methacrylate-co-Zonyl TM®) 75:25, (0.043 g/m$^2$) where Zonyl TM® is a fluorinated acrylate monomer (DuPont) and Paraplex G25® (a polyester sebacate) (C. P. Hall Company) (0.022 g/m$^2$) coated from a mixture of toluene, methanol and cyclohexanone (70:25:5).

Dye-donor Element 2 was coated as described for Dye-donor Element 1, except the dye layer contained 0.28 g/m$^2$ Dye 2, 0.126 g/m$^2$ each of cellulose acetate propionates 482-.5 and 482-20, 0.068 g/m$^2$ poly(butyl methacrylate-co-Zonyl TM®), 0.011 g/m$^2$ Paraplex G25®, and 0.011 g/m$^2$ 2,4,6-trimethylanilid of phenylindandicarboxylic acid (CAS Reg. No. 156081-22-0).

Dye-donor Element 3 was coated as described for Dye-donor Element 1, except the dye layer contained 0.204 g/m$^2$ Dye 10, 0.106 g/m$^2$ each of cellulose acetate propionates 482-.5 and 482-20, 0.061 g/m$^2$ poly(butyl methacrylate-co-Zonyl TM®), 0.022 g/m$^2$ Paraplex G25® and, 0.01 1 g/m$^2$ 2,4,6 trimethylanilid of phenylindandicarboxylic acid.

Dye-donor Element 4 was coated as described for Dye-donor Element 1, except the a subbing layer contained 0.043 gm$^2$ Polymin PC polyethyleneimine (BASF Corp.) and poly(butyl acrylate-co-allyl methacrylate) (98:2) 70 wt. core/poly(glycidyl methacrylate) 30 wt. shell (0.011 g/m$^2$) coated from water; and the dye layer contained 0.327 g/m$^2$ Dye 13, 0.654 g/m$^2$ poly(vinyl butyral) (Butvar B76®, Monsanto Company), and FC-431® fluorocarbon surfactant (3M Company) (0.01 g/m$^2$) coated from a toluene, n-propanol, cyclohexanone (65:30:5) solvent mixture.

On the back side of the dye-donor elements were coated the following compositions in the order listed:

1) a subbing layer of Tyzor TBT®, a titanium tetrabutoxide, (DuPont) (0.16 g/m$^2$) coated from 1-butanol; and
2) a slipping layer of poly(vinyl acetal) (0.38 g/m$^2$) (Sekisui Co.), candellila wax (7% dispersion in methanol) (0.022 g/m$^2$), an amino-terminated poly (dimethylsiloxane) (Huels Co.) (0.011 g/m$^2$) and p-toluenesulfonic acid (0.0003 g/m$^2$) coated form a mixture of 3-pentanone and water (98:2).

Preparation and Evaluation of Thermal Transfer Images

Eleven-step sensitometric thermal dye transfer images were prepared from the above donor and receiver elements The dye side of a dye-donor element approximately 10 cm×15 cm in area was placed in contact with the receiving layer side of a receiving element of the same area. This assemblage was clamped to a stepper motor-driven, 60 mm diameter rubber roller. A thermal head (TDK No. 8I0625, thermostatted at 25° C.) was pressed with a force of 24.4 Newton (2.5 kg) against the donor element side of the assemblage, pushing it against the rubber roller.

The imaging electronics were activated causing the donor-receiver assemblage to be drawn through the printing headlroller nip at 40.3 mm/sec. Coincidentally, the resistive elements in the thermal print head were pulsed for 127.75 μsec/pulse at 130.75 μsec intervals during a 4.575 msec/dot printing cycle (including a 0.391 msec/dot cool down interval). A stepped image density was generated by incrementally increasing the number of pulses/dot from a minimum of 0 to a maximum of 32 pulses/dot. The voltage supplied to the thermal head was approximately 13 v resulting in an instantaneous peak power of 0.318 watt/dot and a maximum total energy of 1.30 mJ/dot. Print room humidity: 48% RH.

After printing, the imaged receiving element was separated from the donor element and placed into an oven at 50° C./50% RH for 3 hours to ensure that the dye was evenly distributed throughout the receiving layer. After incubation, the appropriate Status A reflection densities (red, green or blue) of each of the eleven steps were measured with an X-Rite 820 reflection densitometer. In each of Tables 4 to 7, the density values measured at step number 11 (D-max, a measure of the efficiency of dye transfer) for each dye-donor/dye receiver pair are listed. Dye 1 is magenta in its unprotonated state and cyan when protonated. The completeness of protonation of Dye 1 is measured by the ratio of the Status A red and green densities at step 10. Higher values indicate a greater degree of protonation. This parameter is also listed in Table 4.

Dyes 2 and 13 do not absorb strongly in the visible spectrum in their unprotonated forms. The Status A Blue density of the transferred image should correlate with the degree of protonation but can be confounded with the transfer efficiency of the dye-receiver combination. As another measure of degree of protonation for these dyes, the imaged receiving elements from above were suspended in a closed vessel containing concentrated hydrochloric acid (HCl) for 1 minute. The Status A blue densities of the stepped image was reread as above and the percent (%) increase in density at D-max is listed in Tables 5 and 7. Higher numbers reflect less protonated dye in the original (unfumed) receiving element.

In order to measure the effectiveness of the binding of the basic dyes to the receiving elements, the imaged side of the stepped image was placed in intimate contact with a similarly sized piece of a plasticized poly(vinyl chloride) (PVC) report cover, a 1 kg weight was placed on top and the whole assemblage was incubated in an oven held at 50° C. for 1 week The PVC sheet was separated from the stepped image and the appropriate Status A transmission density in the PVC (a measure of the amount of unwanted dye migration into the PVC) corresponding to the maximum density step of the original stepped image was measured with an X-Rite 820 reflection densitometer. The retransfer densities for each dye-donor dye-receiver combination are listed in Tables 4 to 7. Low numbers indicate effective binding of the dye to the receiving element.

All of the receiver elements, except for C-1, effectively bind the transferred dye. The retransfer density values for Dyes 2 and 13 (Tables 5 and 7) are unreliable because the unprotonated (unbound) dye is nearly colorless. For these dyes a low % increase in Status A blue density indicates more effective protonation/binding of the transferred dye by the acid in the receiving element.

TABLE 4

Data for Dye-donor Element 1

| Dye-receiver Element | Maximum Reflection Density (Status A Red) | Dye Hue Status A R/G Ratio | Retransfer Density (Status A red) |
|---|---|---|---|
| I-1 | 2.1 | 5.8 | 0.03 |
| I-2 | 2.1 | 4.6 | 0.11 |
| I-3 | 2.1 | 6.0 | 0.02 |
| I-4 | 2.4 | 6.0 | 0.04 |
| C-1 | 1.4 | 0.8* | 0.34 |
| C-2 | 2.1 | 5.8 | 0.03 |
| C-3 | 2.2 | 5.7 | 0.03 |

*Purple-magenta color

TABLE 5

Data for Dye-donor Element 2

| Dye-receiver Element | Maximum Reflection Density (Status A Blue) | Retransfer Density (Status A Blue) | % Change in Density After Fuming with HCl (Status A Blue) |
|---|---|---|---|
| I-1 | 1.8 | 0.02 | 1 |
| I-2 | 1.6 | 0.03 | 1 |
| I-3 | 1.6 | 0.03 | 1 |
| I-4 | 1.6 | 0.02 | 1 |
| C-1 | 1.1* | 0.09 | 73 |
| C-2 | 1.6 | 0.01 | 0 |
| C-3 | 1.9 | 0.01 | 0 |

*Very pale yellow, largely unprotonated Dye 2.

TABLE 6

Data for Dye-donor Element 3

| Dye-receiver Element | Maximum Reflection Density (Status A Green) | Retransfer Density (Status A Green) |
|---|---|---|
| I-1 | 2.4 | 0.02 |
| I-2 | 2.1 | 0.09 |
| I-3 | 2.2 | 0.24 |
| I-4 | 2.1 | 0.07 |
| C-1 | 2.3 | 0.46 |
| C-2 | 2.3 | 0.02 |
| C-3 | 2.1 | 0.14 |

TABLE 7

Data for Dye-donor Element 4

| Dye-receiver Element | Maximum Reflection Density (Status A Blue) | Retransfer Density (Status A Blue) | % Change in Density After Fuming with HCl (Status A Blue) |
|---|---|---|---|
| I-1 | 2.0 | 0.02 | 0 |
| I-2 | 2.0 | 0.05 | 0 |
| I-3 | 2.0 | 0.02 | 0 |
| I-4 | 2.0 | 0.02 | 0 |
| C-1 | 0.8* | 0.02 | 85 |
| C-3 | 1.9 | 0.02 | 0 |

*Very pale yellow color, largely unprotonated Dye 6

As the data in Tables 4 to 7 show, the polyester ionomers of the invention are effective at both protonating and binding deprotonated cationic dyes (D)yes 1 and 2), pendant basic dyes (Dye 10), and cationic dye precursors (Dye 13). Although control polyester ionomers C-2 and C-3 are capable of protonating and binding the transferred dyes, these polymers are very unstable towards hydrolysis (see Table 2 above).

Example 3

Stability of Coating Compositions

Samples (20 g each) of aqueous dispersions of polyester ionomers C-2 (22.1% solids) and I-1 (prepared by neutralization of the dispersion of polyester ionomer C-2 to a pH value of 7.0 with approximately 9M aqueous ammonium hydroxide) were placed into capped vials. Both dispersions were fluid and homogeneous. The vials were then warmed to 50° C. for 5 days. The dispersion of polyester ionomer I-1 appeared unchanged while the dispersion of polyester ionomer C-2 had coagulated to an amorphous white mass. Similar results were obtained at ambient temperatures (20° C.) after a period of 4 weeks. These results clearly show that the polyester ionomers of the invention give much more stable coating compositions than the strongly acidic polyester ionomers of the related art.

The invention has been described in detail with particular reference to preferred embodiments thereof, but it will be understood that variations and modifications can be effected within the spirit and scope of the invention.

What is claimed is:

1. A thermal dye transfer assemblage comprising:

(a) a dye-donor element comprising a support having thereon a dye layer comprising a dye dispersed in a polymeric binder, said dye being:

I) an electrically neutral, deprotonated, delocalized cationic dye precursor;

II) a pendant basic dye of the formula $D\text{-}(L\text{-}E)_m$ wherein D represents the residue of a dye, L represents a linking group, E represents a moiety with basic properties and m is an integer of 1–3; or III) a cationic dye precursor having the following structure:

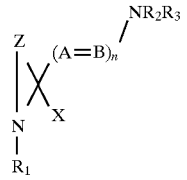

wherein:

$R_1$, $R_2$ and $R_3$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

A and B each independently represents N or CR and may be part of an aromatic or heteroaromatic ring system;

X represents —OR, $—N(R)_2$, —NRCOR, $—NRSO_2R$, —SR, $—SO_2R$, —S(O)R, $—O_2CR$, $—NRCON(R)_2$, $—OCON(R)_2$, $—SO_2N(R)_2$ or —NRCOOR; wherein each R independently represents H or $R_1$;

Z represents the atoms necessary to complete a 5- or 6-membered heterocyclic ring which may optionally be fused with other carbo- or heterocyclic rings;

n represents an integer of from 1–5;

X and $R_1$ may be combined to form a 5–7 membered ring; and;

$R_2$ and $R_3$ may be combined together or independently combined with A or B to form a 5–7 membered ring; and (b) a dye-receiving element comprising a support having thereon a polymeric dye image-receiving layer, said dye-receiving element being in a superposed relationship with said dye-donor element so that said dye layer is in contact with said dye image-receiving layer, said dye image-receiving layer comprising a polyester ionomer comprising a polyester backbone containing units of a salt of a sulfonic acid or sulfonimide and a basic nitrogen-containing compound which has a pKa of its conjugate acid in the range from about 6 to about 10.

2. The assemblage of claim 1 wherein said polyester ionomer has the following formula:

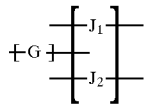

wherein G is the residue of one or more diol components which together comprise 100 mole % of recurring units and is represented by the following structure:

$$—O—(CHR_4CHR_5DB_1)_p—R_6—(OCHR_4CHR_5)_q—O—$$

wherein:

p and q each independently represents an integer from 0–4;

$R_6$ represents an alkylene group of 1 to about 16 carbon atoms; a cycloalkylene group of 5 to about 20 carbon atoms; a cyclobisalkylene group of about 8 to about 20 carbon atoms; a bi- or tri-cycloalkylene group of about 7 to about 16 carbon atoms; a bi- or tri-cyclobisalkylene group of about 9 to about 18 carbon atoms, an arenebisalkylene group of from 8 to about 20 carbon atoms, or an arylene group of 6 to about 12 carbon atoms; and $R_4$ and $R_5$ each independently represents H, a substituted or unsubstituted alkyl group of about 1 to about 6 carbon atoms, or a substituted or unsubstituted aryl group of about 6 to about 12 carbon atoms;

$B_1$ represents O or S;

$J_1$ represents the residue of a diacid component which comprises 8 to 30 mole % of recurring units and is represented by one or more of the following structures:

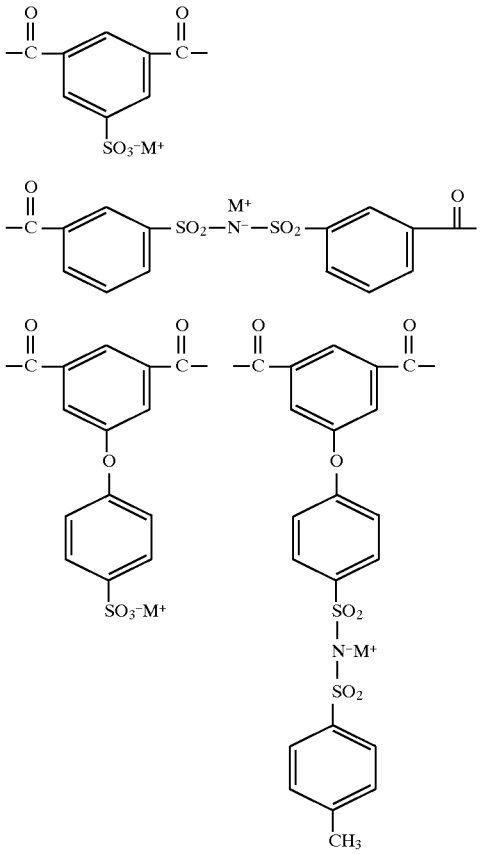

wherein $M^+$ represents the protonated or conjugate acid form of a basic, nitrogen-containing moiety having a pKa measured in water of from about 6 to about 10; and $J_2$ represents the residue of a diacid component which comprises 70 to 92 mole % of recurring units and is represented by one or more of the following structures:

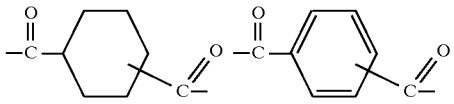

or

-continued

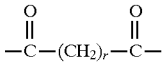

where r represents an integer from 2 to 10.

3. The assemblage of claim 1 wherein said deprotonated, delocalized cationic dye precursor has the following formula:

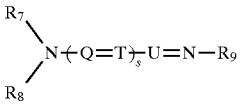

wherein:

Q, T and U form a conjugated link between nitrogen atoms selected from CH, C-alkyl, N, or a combination thereof, the conjugated link optionally forming part of an aromatic or heterocyclic ring;

$R_7$ represents H or a substituted or unsubstituted alkyl group from about 1 to about 10 carbon atoms;

$R_8$ and $R_9$ each individually represents H or a substituted or unsubstituted phenyl or a substituted or unsubstituted alkyl group from about 1 to about 10 carbon atoms; and s is 0 to 11.

4. The assemblage of claim 1 wherein said cationic dye precursor has the following formula:

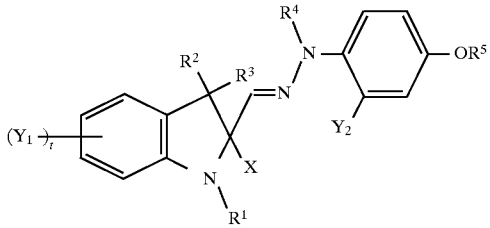

wherein:

$R^1$, $R^2$, $R^3$, $R^4$ and $R^5$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

X represents —OR, —$N(R)_2$, —NRCOR, —$NRSO_2R$, —SR, —$SO_2R$, —S(O)R, —$O_2CR$, —$NRCON(R)_2$, —$OCON(R)_2$, —$SO_2N(R)_2$ or —NRCOOR; wherein each R independently represents H or $R^1$;

$Y_1$ and $Y_2$ each independently represents R, halogen, CN, alkoxy, aryloxy, alkylthio, arylthio, alkoxycarbonyl, aryloxycarbonyl, acylamino, sulfonylamino, nitro, alkylsulfonyl, arylsulfonyl or thiocyano;

t represents an integer of from 1–4;

X and $R^1$ may be combined together with the atoms to which they are attached to form a 5–7 membered ring;

any two of $Y_1$ may be combined to form additional fused rings; and $R^2$ and $R^3$ may be combined together to form a 5–7 membered ring.

5. A process of forming a dye transfer image comprising imagewise-heating a dye-donor element comprising a support having thereon a dye layer comprising a dye dispersed in a polymeric binder, said dye being:

I) an electrically neutral, deprotonated, delocalized cationic dye precursor;

II) a pendant basic dye of the formula D-(L-E)$_m$ wherein D represents the residue of a dye, L represents a linking group, E represents a moiety with basic properties and m is an integer of 1–3; or III) a cationic dye precursor having the following structure:

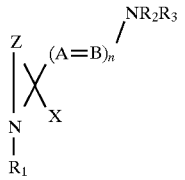

wherein:

$R_1$, $R_2$ and $R_3$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

A and B each independently represents N or CR and may be part of an aromatic or heteroaromatic ring system;

X represents —OR, —N(R)$_2$, —NRCOR, —NRSO$_2$R, —SR, —SO$_2$R, —S(O)R, —O$_2$CR, —NRCON(R)$_2$, —OCON(R)$_2$, —SO$_2$N(R)$_2$ or —NRCOOR; wherein each R independently represents H or $R_1$;

Z represents the atoms necessary to complete a 5- or 6-membered heterocyclic ring which may optionally be fused with other carbo- or heterocyclic rings;

n represents an integer of from 1–5;

X and $R_1$ may be combined to form a 5–7 membered ring; and;

$R_2$ and $R_3$ may be combined together or independently combined with A or B to form a 5–7 membered ring;

and imagewise transferring said dye to a dye-receiving element to form said dye transfer image, said dye-receiving element comprising a support having thereon a polymeric dye image-receiving layer comprising a polyester ionomer comprising a polyester backbone containing units of a salt of a sulfonic acid or sulfonimide and a basic nitrogen-containing compound which has a pKa of its conjugate acid in the range from about 6 to about 10.

6. The process of claim 5 wherein said polyester ionomer has the following formula:

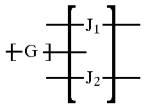

wherein G is the residue of one or more diol components which together comprise 100 mole % of recurring units and is represented by the following structure:

$$—O—(CHR_4CHR_5DB_1)_p—R_6—(OCHR_4CHR_5)_q—O—$$

wherein:

p and q each independently represents an integer from 0–4;

$R_6$ represents an alkylene group of 1 to about 16 carbon atoms; a cycloalkylene group of 5 to about 20 carbon atoms; a cyclobisalkylene group of about 8 to about 20 carbon atoms; a bi- or tri-cycloalkylene group of about 7 to about 16 carbon atoms; a bi- or tri-cyclobisalkylene group of about 9 to about 18 carbon atoms, an arenebisalkylene group of from 8 to about 20 carbon atoms, or an arylene group of 6 to about 12 carbon atoms; and $R_4$ and $R_5$ each independently represents H, a substituted or unsubstituted alkyl group of about 1 to about 6 carbon atoms, or a substituted or unsubstituted aryl group of about 6 to about 12 carbon atoms;

B, represents O or S;

$J_1$ represents the residue of a diacid component which comprises 8 to 30 mole % of recurring units and is represented by one or more of the following structures:

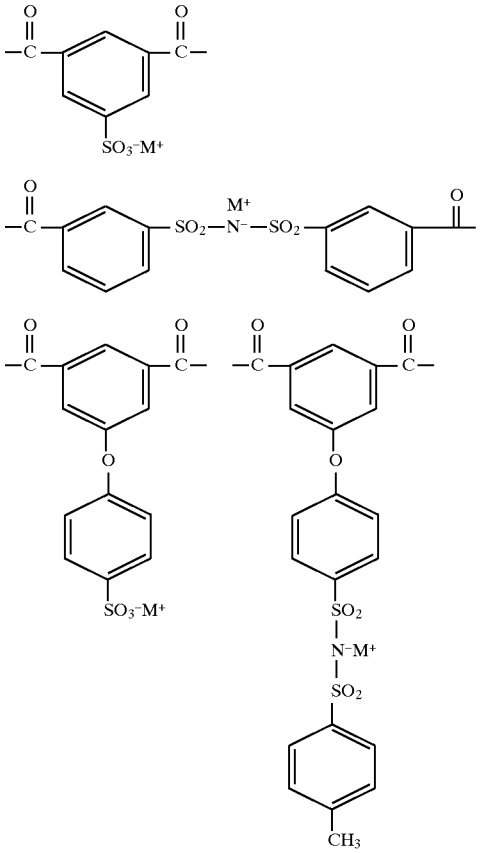

wherein $M^+$ represents the protonated or conjugate acid form of a basic, nitrogen-containing moiety having a pKa measured in water of from about 6 to about 10; and $J_2$ represents the residue of a diacid component which comprises 70 to 92 mole % of recurring units and is represented by one or more of the following structures:

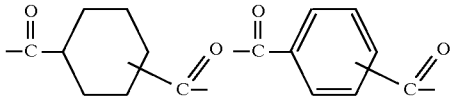

or

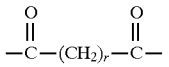

where r represents an integer from 2 to 10.

7. The process of claim 5 wherein said deprotonated, delocalized cationic dye precursor has the following formula:

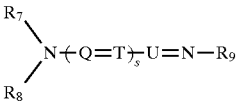

wherein:

Q, T and U form a conjugated link between nitrogen atoms selected from CH, C-alkyl, N, or a combination thereof, the conjugated link optionally forming part of an aromatic or heterocyclic ring;

$R_7$ represents H or a substituted or unsubstituted alkyl group from about 1 to about 10 carbon atoms;

$R_8$ and $R_9$ each individually represents H or a substituted or unsubstituted phenyl or a substituted or unsubstituted alkyl group from about 1 to about 10 carbon atoms; and s is 0 to 11.

8. The process of claim 5 wherein said cationic dye precursor has the following formula:

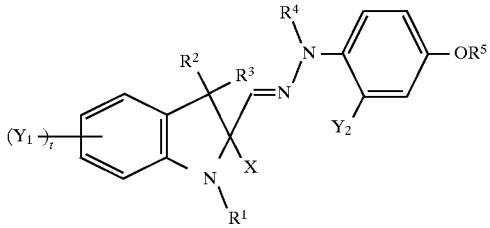

wherein:

$R^1$, $R_2$, $R^3$, $R^4$ and $R^5$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

X represents —OR, —$N(R)_2$, —NRCOR, —$NRSO_2R$, —SR, —$SO_2R$, —S(O)R, —$O_2CR$, —$NRCON(R)_2$, —$OCON(R)_2$, —$SO_2N(R)_2$ or —NRCOOR; wherein each R independently represents H or $R^1$;

$Y_1$ and $Y_2$ each independently represents R, halogen, CN, alkoxy, aryloxy, alkylthio, arylthio, alkoxycarbonyl, aryloxycarbonyl, acylamino, sulfonylamino, nitro, alkylsulfonyl, arylsulfonyl or thiocyano;

t represents an integer of from 1–4;

X and $R^1$ may be combined together with the atoms to which they are attached to form a 5–7 membered ring;

any two of $Y_1$ may be combined to form additional fused rings; and $R^2$ and $R^3$ may be combined together to form a 5–7 membered ring.

* * * * *

UNITED STATES PATENT AND TRADEMARK OFFICE

CERTIFICATE OF CORRECTION

PATENT NO. : 5,804,531

DATED : September 8, 1998

INVENTOR(S) : Steven Evans et al

It is certified that error appears in the above-identified patent and that said Letters Patent is hereby corrected as shown below:

Abstract, after the structure should read --and--.

Col. 21, line 60, should read -- $O\text{-}(CHR_4CHR_5DB_1)_p\text{-}R_6\text{-}(OCHR_4CHR_5)_q\text{-}O$- --

Col. 23, line 24, should read -- $CH_2$--.

Col. 24, line 13, should --$R^2$--.

Signed and Sealed this

Second Day of March, 1999

*Attest:*

Q. TODD DICKINSON

*Attesting Officer*

*Acting Commissioner of Patents and Trademarks*